US009044954B1

(12) United States Patent
Stamp et al.

(10) Patent No.: US 9,044,954 B1
(45) Date of Patent: Jun. 2, 2015

(54) INK JET PRINTER

(71) Applicant: VIDEOJET TECHNOLOGIES INC., Wood Dale, IL (US)

(72) Inventors: Michael Stamp, Leicestershire (GB); Philip Blowfield, Northaptonshire (GB); Robert Smith, Northamptonshire (GB)

(73) Assignee: Videojet Technologies Inc., Wood Dale, IL (US)

( * ) Notice: Subject to any disclaimer, the term of this patent is extended or adjusted under 35 U.S.C. 154(b) by 0 days.

(21) Appl. No.: 14/397,616

(22) PCT Filed: May 13, 2013

(86) PCT No.: PCT/US2013/040698
§ 371 (c)(1),
(2) Date: Oct. 28, 2014

(87) PCT Pub. No.: WO2013/173200
PCT Pub. Date: Nov. 21, 2013

Related U.S. Application Data

(60) Provisional application No. 61/646,421, filed on May 14, 2012.

(51) Int. Cl.
*B41J 2/02* (2006.01)
*B41J 2/175* (2006.01)

(52) U.S. Cl.
CPC ..... *B41J 2/175* (2013.01)

(58) Field of Classification Search
USPC ..... 347/7, 28, 29, 73, 85, 89, 90
See application file for complete search history.

(56) References Cited

U.S. PATENT DOCUMENTS

| | | | | |
|---|---|---|---|---|
| 4,827,278 | A * | 5/1989 | Lecheheb | 347/7 |
| 4,998,116 | A | 3/1991 | Regnault | |
| 5,469,202 | A | 11/1995 | Stephens | |
| 8,333,463 | B2 | 12/2012 | Nagamine | |
| 8,360,564 | B2 | 1/2013 | Stamp | |
| 8,366,252 | B2 * | 2/2013 | Zaba et al. | 347/86 |

(Continued)

FOREIGN PATENT DOCUMENTS

| | | |
|---|---|---|
| JP | H01247167 | 10/1989 |
| JP | 2004-322558 | 11/2004 |
| WO | 2012038520 | 3/2012 |

OTHER PUBLICATIONS

International Search Report for PCT/US2013/040698, Jul. 16, 2013.

*Primary Examiner* — Anh T. N. Vo
(74) *Attorney, Agent, or Firm* — Joseph Yosick

(57) ABSTRACT

A continuous ink jet printer including an ink tank for holding ink, an ink nozzle in fluid communication with the ink tank for ejecting ink droplets, and a gutter for receiving, through an ink-receiving inlet thereof, ink droplets which are not used for printing. A gutter flow path starts at the ink-receiving inlet for ink that has entered the gutter through the ink-receiving inlet, and provides fluid communication to the ink tank. A return line is in fluid communication with the gutter for conveying air to enter the gutter flow path. A makeup tank is in vapor communication with the ink tank to allow air to be conveyed from the ink tank to the makeup tank. A condenser is in fluid communication with the makeup reservoir and the return line for condensing solvent.

20 Claims, 3 Drawing Sheets

(56) References Cited

U.S. PATENT DOCUMENTS

| | | | | |
|---|---|---|---|---|
| 8,388,118 | B2 * | 3/2013 | Hill | 347/73 |
| 8,672,449 | B2 | 3/2014 | Arima | |
| 8,727,466 | B2 | 5/2014 | Inoue | |
| 8,882,231 | B2 | 11/2014 | Morgan | |
| 8,888,209 | B2 * | 11/2014 | Pouzet | 347/7 |
| 2010/0026754 | A1 | 2/2010 | Nagamine | |
| 2011/0141207 | A1 | 6/2011 | Fost | |
| 2012/0001968 | A1 | 1/2012 | Inoue | |

* cited by examiner

INK JET PRINTER

RELATED APPLICATIONS

This application claims priority under 35 U.S.C. §371 from PCT Application No. PCT/US2013/040698, filed in English on May 13, 2013, which claims the benefit of U.S. Patent Application No. 61/646,412, filed on May 14, 2012, the disclosures of all of which are incorporated by reference herein in their entireties.

BACKGROUND

The present invention relates to ink jet printing and more particularly to a continuous ink jet printer with reduced solvent consumption.

In ink jet printing systems the print is made up of individual droplets of ink generated at a nozzle and propelled towards a substrate. There are two principal systems: drop on demand where ink droplets for printing are generated as and when required; and continuous ink jet printing in which droplets are continuously produced and only selected ones are directed towards the substrate, the others being recirculated to an ink supply.

Continuous ink jet printers supply pressurized ink to a print head assembly having a drop generator where a continuous stream of ink emanating from a nozzle is broken up into individual regular drops by an oscillating piezoelectric element. The drops are directed past a charge electrode where they are selectively and separately given a predetermined charge before passing through a transverse electric field provided across a pair of deflection plates. Each charged drop is deflected by the field by an amount that is dependent on its charge magnitude before impinging on the substrate whereas the uncharged drops proceed without deflection and are collected at a gutter from where they are recirculated to the ink supply for reuse. A phase measurement system is also usually present as part of deflection plate assembly and is used to ensure synchronization of deflection for the droplets. The charged drops bypass the gutter and hit the substrate at a position determined by the charge on the drop and the position of the substrate relative to the print head assembly. Typically the substrate is moved relative to the print head assembly in one direction and the drops are deflected in a direction generally perpendicular thereto, although the deflection plates may be oriented at an inclination to the perpendicular to compensate for the speed of the substrate (the movement of the substrate relative to the print head assembly between drops arriving means that a line of drops would otherwise not quite extend perpendicularly to the direction of movement of the substrate).

In continuous ink jet printing a character is printed from a matrix comprising a regular array of potential drop positions. Each matrix comprises a plurality of columns (strokes), each being defined by a line comprising a plurality of potential drop positions (e.g. seven) determined by the charge applied to the drops. Thus each usable drop is charged according to its intended position in the stroke. If a particular drop is not to be used then the drop is not charged and it is captured at the gutter for recirculation. This cycle repeats for all strokes in a matrix and then starts again for the next character matrix.

Ink is delivered under pressure to the print head assembly from an ink supply system that is generally housed within a sealed compartment of a cabinet that includes a separate compartment for control circuitry and a user interface panel. The system includes a main pump that draws the ink from a reservoir or tank via a filter and delivers it under pressure to the print head assembly. As ink is consumed the reservoir is refilled as necessary from an ink source such as a replaceable ink cartridge that is releasably connected to the reservoir by a supply conduit. The ink is fed from the reservoir via a flexible delivery conduit to the print head assembly. Electrical power to operate the heater in the print head assembly and the drop generator are supplied by power supply system cables, typically forming part of the supply conduit. The unused ink drops captured by the gutter are recirculated to the reservoir via a return conduit, typically located as part of the supply conduit, by a pump. The flow of ink in each of the conduits is generally controlled by solenoid valves and/or other like components.

As the ink circulates through the system, there is a tendency for it to thicken as a result of solvent evaporation. This is particularly a problem in relation to the recirculated ink that has been exposed to air in its passage between the nozzle and the gutter. Air that is used to clear the gutter has to be exhausted to atmosphere carrying solvent with it. To compensate for this "make-up" solvent is added to the ink as required from a solvent source such as a replaceable solvent cartridge so as to maintain the ink viscosity within desired limits when the ink is at the correct operating temperature. The loss of solvent due to evaporation increases the cost of operating the printer (due to the need to supply makeup solvent) and also can create undesirable odors in the area around the printer. The solvent may also be used for flushing components of the print head assembly, such as the nozzle and the gutter, in a cleaning cycle.

BRIEF SUMMARY

The present disclosure provides a continuous ink jet printing system with improved management of ink viscosity and reduced solvent loss from the system.

In one aspect, a continuous ink jet printer including an ink tank for holding ink, an ink nozzle in fluid communication with the ink tank for ejecting ink droplets, and a gutter for receiving, through an ink-receiving inlet thereof, ink droplets which are not used for printing. A gutter flow path starts at the ink-receiving inlet for ink that has entered the gutter through the ink-receiving inlet, and provides fluid communication to the ink tank. A return line is in fluid communication with the gutter for conveying air to enter the gutter flow path. A makeup tank is in vapor communication with the ink tank to allow air to be conveyed from the ink tank to the makeup tank. A condenser is in fluid communication with the makeup reservoir and the return line for condensing solvent from the makeup tank.

In another aspect, a method of operating a continuous ink jet printer comprises conveying ink from an ink tank to an ink nozzle. Ink droplets are ejected from the nozzle. Ink droplets which are not used for printing are received through an ink-receiving inlet of a gutter. Ink that has entered the gutter is conveyed through the ink-receiving inlet to the ink tank. Air from a makeup tank is conveyed to the gutter flow path. Air from the ink tank is conveyed to the makeup tank. Solvent is condensed from air in fluid communication with the gutter and the condensed solvent is conveyed to a makeup reservoir The foregoing paragraphs have been provided by way of general introduction, and are not intended to limit the scope of the following claims. The presently preferred embodiments, together with further advantages, will be best understood by reference to the following detailed description taken in conjunction with the accompanying drawings.

DETAILED DESCRIPTION

Figure 1:
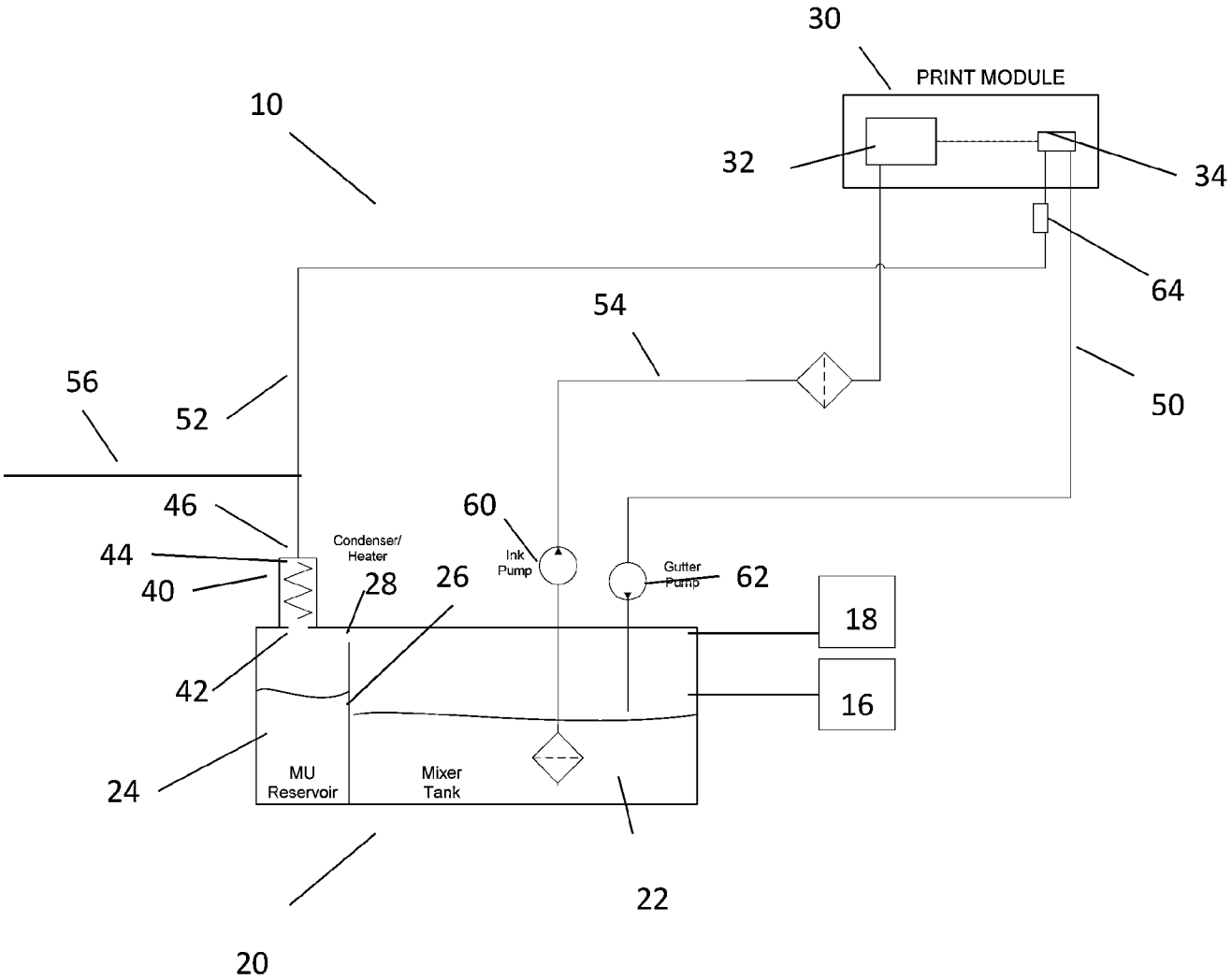
FIG. 1 is schematic view of a first embodiment of a printing system.

The invention is described with reference to the drawings in which like elements are referred to by like numerals. The relationship and functioning of the various elements of this invention are better understood by the following detailed description. However, the embodiments of this invention as described below are by way of example only, and the invention is not limited to the embodiments illustrated in the drawings.

The present disclosure provides a continuous ink jet printing system with improved management of ink viscosity and reduced solvent loss from the system. Solvent is recovered from the air in the gutter line and made available for reuse within the system. A condenser and/or a heater is used to prevent liquid condensate from returning to the gutter. The system allows control of the gutter entrance airflow to ensure reliable gutter clearing.

FIG. 1 is a schematic view showing a continuous ink jet printer 10. The printer 10 includes a fluid system 20, a print module 30, and a condenser 40. The fluid system 20 includes an ink or mixer tank 22 for holding ink and a makeup tank 24 for holding solvent. Ink source 16 and solvent source 18 provide fluids to mixer tank 22. Solvent is added to the ink or mixer tank 22 during operation of the printer to replace solvent loss due to evaporation and to properly control the ink viscosity. Inks for continuous ink jet printers are typically complex mixtures of many substances, with a large proportion of volatile organic solvents. Typical organic solvents include methyl ethyl ketone (MEK), acetone, and ethanol. The print module 30 includes a nozzle 32 in fluid communication with the ink tank for ejecting ink droplets and a gutter 34 for receiving, through an ink-receiving inlet thereof, ink droplets which are not used for printing. A gutter flow path 50 starts at the ink-receiving inlet or orifice and provides fluid communication to the ink tank, for ink and air that has entered the gutter 34 through the ink-receiving inlet. A return line 52 is in fluid communication with the gutter 34 for conveying air from the makeup tank 24 to enter the gutter flow path 50.

The makeup tank 24 is in vapor communication with the ink tank 22 to allow air to be conveyed from the ink tank to the makeup tank. By "vapor communication" is meant that vapor, but not necessarily liquid, can travel between the makeup tank 24 and the ink tank 22. The makeup tank 24 is to be distinguished from conventional solvent sources (like solvent source 18) used in CIJ printers. Makeup tank 24 includes liquid solvent condensed from air in the printer system itself, in contrast to liquid makeup added to the system from a liquid source like solvent source 18. In general, liquid ink will not be conveyed from ink tank 22 to makeup tank 24, but rather only solvent laden air. In one embodiment, fluid system 20 may be a single unit, including ink tank 22 and makeup tank 24, that is divided by a wall 26, for example, into fluid storage areas 22 and 24. An opening 28 is disposed at a top portion of the wall 26 to provide vapor communication between ink tank 22 and makeup tank 24 under normal operation. However, there may be an additional fluid connection (not shown in FIG. 1) between ink tank 22 and makeup tank 24 to allow makeup to be added to the ink tank 22 if the ink viscosity becomes too high or the makeup tank 24 becomes too full, for example. In another embodiment, there is no liquid connection between the ink tank 22 and the makeup tank 24. In one embodiment, the ink tank 22 may contain a volume of 0.5 L to 2 L, generally between 1 L and 1.5 L. The makeup tank 24 may contain a volume of 0.2 L to 1 L, generally between 0.5 L to 0.75 L.

A condenser 40 is in fluid communication with the makeup tank 24 and the return line 52 for condensing solvent from the makeup tank 24. Condenser 40 is preferably disposed between makeup tank 24 and the return line 52 to gutter 34. Condenser 40 may be disposed directly above (e.g. at a top portion of) the makeup tank 24. The condenser 40 is adapted to receive exhaust from the makeup tank 24 and condense solvent from the exhaust. Exhaust from the ink reservoir 24 will generally include air, organic solvent, and ink particles. The makeup tank 24 and ink tank 22 may be under pressure to provide a force to move the exhaust. The pressure may be any suitable pressure, but it has been found that a pressure of at least 0.1 Bar is sufficient.

Figure 2:
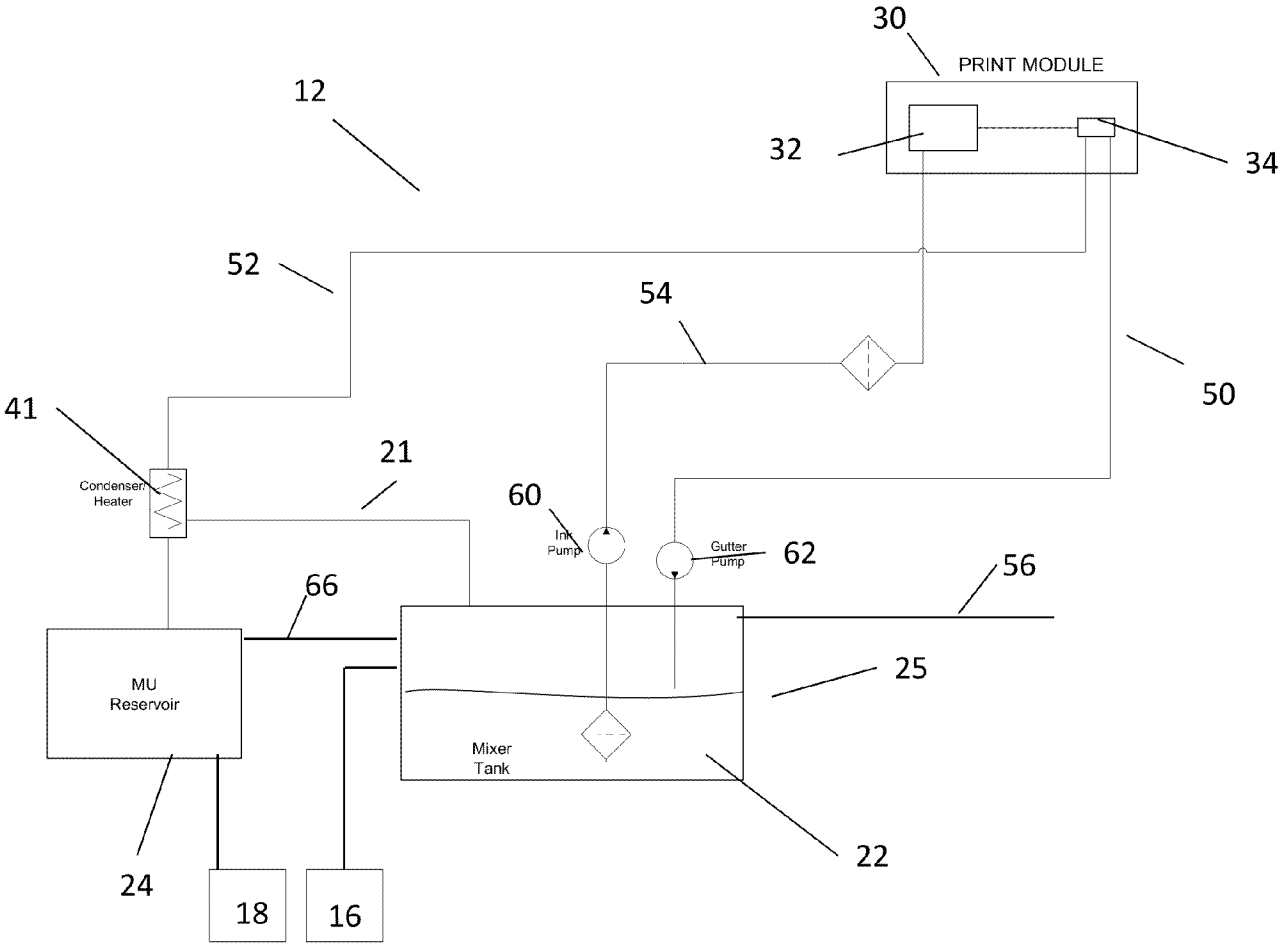
FIG. 2 is schematic view of a second embodiment of a printing system.

In a second embodiment of a printer 12 with fluid system 25 shown in FIG. 2, the ink tank 22 and makeup tank 24 are separate containers. Line 21 provides fluid communication from ink tank 22 to condenser 41. The condenser 41 is adapted to receive exhaust from the ink tank 22 and the makeup tank 24 and condense the solvent from the exhaust, returning the condensed solvent to makeup tank 24. Line 66 may provide fluid communication between solvent tank 24 and mixer tank 22 to allow makeup to be added to the ink tank 22 if the ink viscosity becomes too high or the makeup tank 24 becomes too full, for example. Solvent source 18 may provide solvent to makeup tank 24 and/or ink tank 22. It will be apparent to those skilled in the art that, to the extent features are described herein with respect to the first embodiment of a fluid system 20, they may also be applied to the second embodiment of a fluid system 25.

The condenser 40 may be an active condenser. Alternatively condenser 40 may be a passive condenser, meaning it does not require any power or moving parts to operate. Such condensers are known in the art and any suitable condenser may be used. The condenser 40 includes an inlet 42 for receiving the exhaust from the makeup tank 24. A condensing chamber 44 is in fluid communication with the inlet 42. Because the walls of the condensing chamber 44 are at a lower temperature than the exhaust, fluid condenses from the exhaust in the condensing chamber 44. This allows condensed solvent and ink particles to be removed from the air stream. An outlet 46 is in fluid communication with the return line 52 for providing air flow from the condenser 40 to the gutter 34. Condensed fluid flows back into makeup tank 24 from condenser 40. Condenser 40 (or 41) is preferably disposed physically above makeup tank 24 to allow condensed solvent to flow by gravity into makeup tank 24.

The system 10 may include a gutter pump 62 (or venturi jet pump or a vacuum source) in fluid communication with the gutter 34 to draw air and unused ink droplets from the gutter 34 into the ink tank 32 via line 50. The system 10 may include an ink pump 60 in fluid communication between the ink tank 22 and the nozzle 32 to provide ink to the nozzle via line 50. A vent or purge line 56 may be used under certain conditions to purge air from the system. The purge line 56 may be located in any suitable location, such as the ink tank 22 (as shown in FIG. 2), the makeup tank 24, or off of the recirculation line 52 (as shown in FIG. 1).

The system 10 may include a heater to heat the air to ensure that it does not include any liquid solvent. In one embodiment, a heater is integrated into the condenser 40 to heat the air used in the recirculation line 52. In another embodiment, a heater 64 is provided in the recirculation line 52 close to the point that the recirculated air is returned to the gutter 34. The heater 64 can be used to force any remaining solvent to a vapor state so that liquid solvent does not interfere with gutter clearing.

The system 10 may include small bore piping or high recirculation air flow in the return line, compared to a conventional continuous ink jet ink jet printer. The use of small bore piping and/or increased air flow reduces the size of the solvent droplets that are returned to the gutter 34 if the system is run without sufficient condensing or heating, to ensure only vapor reaches the gutter 34. For example, conventional CIJ printers may use piping with an inner diameter (ID) of 4 mm or 1.6 mm. The piping of the present embodiment may have an ID of 1.6 mm or less, 1.0 mm or less, or 0.5 mm or less.

The system described herein may be used with existing continuous ink jet systems with the necessary modification, such as that disclosed in U.S. Pat. No. 8,408,684 (commonly assigned with the present application to Videojet Technologies Inc.), the contents of which are hereby incorporated by reference. The system may include other components that are commonly used in continuous ink jet printers but which are not shown in the present figures. For example, the system may include a solvent line (not shown) from solvent source 18 or makeup tank 24 to the print head 30, for flushing the nozzle during startup and shutdown. Although particular configurations are shown in FIGS. 1 and 2, it is apparent that various components may be combined together in different orientations and configurations. The system may include separate ink and solvent containers, such as the cartridges disclosed in U.S. Pat. No. 8,366,252 (commonly assigned with the present application to Videojet Technologies Inc.), the contents of which are hereby incorporated by reference. In particular, an ink source 16 is provided to mixer tank 22 and a solvent source 18 is provided to mixer tank 22 and/or solvent reservoir 24.

Figure 3:
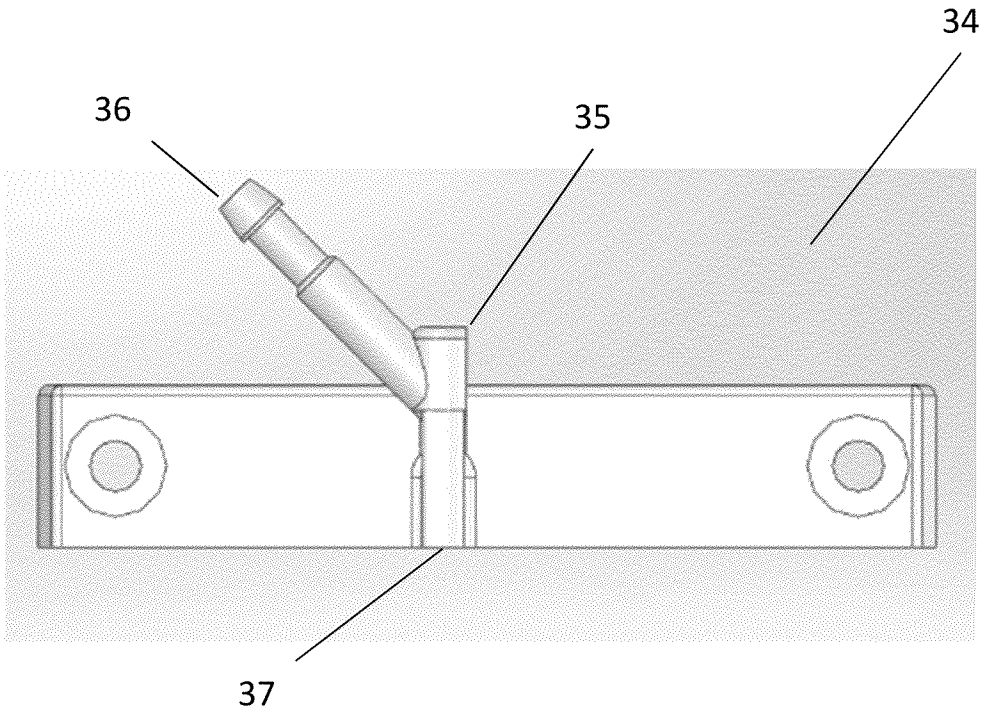
FIG. 3 is a cross sectional view of an embodiment of a gutter.

The gutter 34 may be of any suitable design. One embodiment of a gutter is shown in FIG. 3. It is apparent that the gutter 34 will have a first inlet or orifice 35 to collect ink droplets that are not used for printing, a second inlet 36 for the recirculated air from line 52, and an outlet 37 connected to gutter flow path 50 for the combined ink and air mixture. Ink inlet 35 and gutter outlet 37 may be disposed essentially in a straight line with each other, with air inlet 36 disposed at an acute angle of about 45° with respect to ink inlet 35. It will be apparent that other gutter designs are possible. Gutter designs such as those shown in U.S. Pat. No. 8,388,118 (assigned to Linx Printing Technologies Ltd.), the contents of which are hereby incorporated by reference, may be used with the system. The gutter may be concave or slotted such as that shown in US 20110134183. The disclosed embodiments may be used with single nozzle CIJ systems, dual nozzle systems, or multiple nozzle (binary array) systems.

The printer 10 may be operated as follows. The system 10 may include valves and restrictors to reduce or turn off recirculation to give gutter suction during jet startup or other operating conditions. Thus, upon startup, purge line 56 may be open to allow air to be removed from the system. Ink pump 60 transfers ink from ink tank 22 through ink line 54 into nozzle 32. Ink droplets are ejected from nozzle 32. Droplets that are not used for printing are collected in gutter 34 and returned to the ink tank 22 via gutter flow path 50 and gutter pump 62. The air in gutter flow path 50 will be laden with solvent and include ink particles. Solvent-laden air passes through opening 28 from ink tank 22 to makeup tank 24. Condenser 40 condenses solvent from the air flow and returns the solvent to makeup tank 24. Air is recirculated through recirculation line 52 to gutter 34. Line 52 may directly connect the condenser 40 to the print head 30 and gutter 34. Compared to a conventional continuous ink jet system, this arrangement reduces or virtually eliminates the amount of ambient air introduced into the system and thus reduces solvent loss to the exterior environment. The system 10 may have various controls on the ink and solvent levels in tanks 22 and 24. For example, during cleaning, solvent may be run through the system to removes dried ink and debris. The system 10 thus may include a level sensor so that if the volume of solvent in the makeup tank 24 becomes too high, it is transferred to another container.

In an alternative embodiment the condenser 41 (or other separator) could be located in the print head 30 closer to the receiving orifice of the gutter 34. This location of the condenser 41 has the advantage of overcoming the possibility of any further liquid condensing in the recirculation line 52, which may be located some meters away from the ink system. Additionally, this allows the recirculation line 52 to act as part of the condensing system.

The system disclosed herein has an advantage in that it gives the ability to thicken the ink (i.e. by condensing solvent) while recirculating air back to the gutter rather than venting to atmosphere. It also makes the recovered solvent available for reuse. It reduces the likelihood of gutter welling/overflow by reducing the liquid within the recirculating line. It also provides reduced make-up consumption and cost of ownership, enhanced ability to operate in high humidity without air dryer, reduced solvent odor and VOC emissions, and reduced ink oxidization. The system preferably is able to reduce solvent consumption to less than 3.5 ml/hr, preferably less than 3.0 ml/hr, or less than 2.5 ml/hr, with a volatile organic solvent such as MEK, acetone, or ethanol. Tests using the disclosed system have been able to achieve solvent use of 3.3 ml/hr using MEK.

The various components of the printer systems disclosed herein may be made according to conventional methods and of conventional materials familiar to those skilled in the art.

The described and illustrated embodiments are to be considered as illustrative and not restrictive in character, it being understood that only the preferred embodiments have been shown and described and that all changes and modifications that come within the scope of the inventions as defined in the claims are desired to be protected. It should be understood that while the use of words such as "preferable", "preferably", "preferred" or "more preferred" in the description suggest that a feature so described may be desirable, it may nevertheless not be necessary and embodiments lacking such a feature may be contemplated as within the scope of the invention as defined in the appended claims. In relation to the claims, it is intended that when words such as "a," "an," "at least one," or "at least one portion" are used to preface a feature there is no intention to limit the claim to only one such feature unless specifically stated to the contrary in the claim. When the language "at least a portion" and/or "a portion" is used the item can include a portion and/or the entire item unless specifically stated to the contrary.

What is claimed is:

1. A continuous ink jet printer comprising an ink tank for holding ink;

a print head;

an ink nozzle disposed in the print head and in fluid communication with the ink tank for ejecting ink droplets;

a gutter disposed in the print head for receiving, through an ink-receiving inlet thereof, ink droplets which are not used for printing;

a gutter flow path starting at the ink-receiving inlet, for ink that has entered the gutter through the ink-receiving inlet, and providing fluid communication to the ink tank;

a makeup tank is in vapor communication with the ink tank to allow air to be conveyed from the ink tank to the makeup tank;

a return line is in fluid communication between the makeup tank and the print head for conveying air from the makeup tank to enter the gutter flow path; and a condenser is in fluid communication with the makeup tank and the return line, the condenser disposed between the makeup tank and the return line, the condenser adapted to receive exhaust from the makeup tank and condense solvent from the exhaust, the condensed solvent flowing into the makeup tank.

2. The continuous ink jet printer of claim 1, further comprising a pump disposed in the gutter flow path for conveying fluid from the gutter.

3. The continuous ink jet printer of claim 1, further comprising a vacuum source disposed in the gutter flow path for conveying fluid from the gutter.

4. The continuous ink jet printer of claim 1, further comprising an ink supply line disposed between the ink tank and the ink nozzle.

5. The continuous ink jet printer of claim 4, further comprising an ink pump disposed in the ink supply line.

6. The continuous ink jet printer of claim 1 wherein the condenser is a passive condenser.

7. The continuous ink jet printer of claim 1 wherein the condenser is an active condenser.

8. The continuous ink jet printer of claim 1 wherein the condenser is disposed above the makeup tank.

9. The continuous ink jet printer of claim 1 further comprising a heater disposed in the return line adjacent the condenser for heating air conveyed from the makeup tank.

10. The continuous ink jet printer of claim 1 further comprising a heater disposed in the return line adjacent the gutter for heating air conveyed from the gutter.

11. The continuous ink jet printer of claim 1 wherein the makeup tank and the ink tank are integrated in a single component.

12. The continuous ink jet printer of claim 11 wherein the single component comprises a wall disposed between the makeup tank and the ink tank with an opening adjacent a top of the component for allowing vapor communication between the makeup tank and the ink tank.

13. The continuous ink jet printer of claim 1 wherein the makeup tank and the ink tank are separate components.

14. The continuous ink jet printer of claim 1 wherein the return line comprises air with evaporated solvent at an amount less than saturation and is substantially free of liquid solvent.

15. The continuous ink jet printer of claim 1 further comprising a vent to exhaust air from the printer.

16. The continuous ink jet printer of claim 1 wherein the return line is in fluid communication between the makeup tank and the gutter for conveying air from the makeup tank to the gutter flow path.

17. A method of operating a continuous ink jet printer comprising steps of:

conveying ink from an ink tank to an ink nozzle;

ejecting ink droplets from the nozzle;

receiving, through an ink-receiving inlet of a gutter, ink droplets which are not used for printing;

conveying ink that has entered the gutter through the ink-receiving inlet to the ink tank;

conveying air from a makeup tank to the print head;

conveying air from the ink tank to the makeup tank; and condensing solvent from air from the makeup tank and conveying the condensed solvent to the makeup tank.

18. The method of claim 17 further comprising venting air from the printer to an ambient environment.

19. The method of claim 17 further comprising removing solvent from the ink tank by condensing solvent into the makeup tank.

20. The method of claim 17 wherein the printer has a solvent consumption of less than 3.5 ml/hr with a volatile organic solvent selected from MEK, acetone, ethanol, and mixtures thereof.

* * * * *